United States Patent [19]

Melanson et al.

[11] Patent Number: 4,886,956

[45] Date of Patent: Dec. 12, 1989

[54] METHOD OF ELECTRODING PTC HEATERS

[75] Inventors: Lionel J. Melanson, Casco, Me.; Thomas J. Sentementes, Wakefield, Mass.

[73] Assignee: GTE Products Corporation, Stamford, Conn.

[21] Appl. No.: 262,636

[22] Filed: Oct. 26, 1988

[51] Int. Cl.[4] ..... H05B 3/08; H05B 3/44

[52] U.S. Cl. ..... 219/541; 219/505; 219/381; 156/659.1; 156/665

[58] Field of Search ..... 219/374–376, 219/381, 382, 504, 505, 541, 548, 549, 307, 338; 29/847; 338/22 R; 156/656, 659.1, 665; 174/68.5

[56] References Cited

U.S. PATENT DOCUMENTS

| | | | |
|---|---|---|---|
| 2,990,310 | 6/1961 | Chan | 174/68.5 |
| 3,927,300 | 12/1975 | Wada | 219/381 |
| 4,032,752 | 6/1977 | Ohmura | 219/541 |
| 4,292,388 | 9/1981 | Ikeda | 156/665 |
| 4,335,506 | 6/1982 | Chiu | 156/665 |
| 4,349,411 | 9/1982 | Okinaka | 156/659.1 |
| 4,570,046 | 2/1986 | Melanson | 219/505 |

*Primary Examiner*—Bruce A. Reynolds
*Assistant Examiner*—Leon K. Fuller
*Attorney, Agent, or Firm*—James Theodosopoulos

[57] ABSTRACT

A passaged PTC heater is electroded by hot aluminum spraying. A hot alkaline solution is used to dissolve and remove undesired aluminum that may be coated on the passage walls. However, prior thereto, the aluminum electrode coating is covered with a protective solvent-removable alkaline-resistant resist ink.

2 Claims, No Drawings

METHOD OF ELECTRODING PTC HEATERS

This invention concerns PTC heaters having passages through which a fluid (gas or liquid) can flow to be heated. Such heaters are shown in U.S. Pat. Nos. 3,927,300, 4,032,752, 4,107,515, 4,108,125, 4,177,778, 4,180,901, 4,189,509, 4,189,700, 4,198,669, 4,245,146, 4,384,563, 4,387,690 and 4,570,046. The invention is particularly concerned with such heaters in which the electrodes are formed by hot aluminum spraying. Such electroding is disclosed in U.S. Pat. Nos. 3,676,211, 3,927,300, 4,032,752 and 4,570,046. A problem with such an electroding method is that aluminum can sometimes be undesirably deposited on the inner walls of the passages. This problem is pointed out in U.S. Pat. No. 4,032,752 at column 1, lines 43–52, as well as in U.S. Pat. No. 3,927,300 at column 5, lines 31–52. The latter patent discloses spraying at an angle to obviate the problem. However, angle spraying does not completely eliminate aluminum coating on the passage walls.

A commonly used method of preventing aluminum coating on areas where it is not desired is to mask such areas prior to aluminum spraying. Such masking is disclosed in U.S. Pat. Nos. 4,189,509, 4,189,700 and 4,570,046. However, the masking there is generally on exterior surfaces. It is generally not feasible to mask the inner walls of the passages prior to aluminum spraying.

This invention discloses a process for aluminum electroding passaged PTC heaters which completely eliminates aluminum coating on the inner walls of the passages. In this invention, both surfaces of a somewhat flat passaged PTC heater are hot aluminum sprayed to provide an adherent aluminum coating on both surfaces. During this step, some aluminum is undesirably deposited on parts of the inner walls of the passages.

The flat aluminum coated surfaces are then coated with a masking material which is resistant to alkaline solution. Because the surfaces to which the masking material is applied are flat, the masking material can be readily applied such as by, for example, roller coating. The PTC heater is then immersed in a hot alkaline solution which dissolves and removes all aluminum which is not coated with protective masking material. After rinsing and drying, the masking material is removed by means of a suitable solvent. The result is a PTC heater having an aluminum electrode on both surfaces without any aluminum on the walls of the passages between the two surfaces.

This invention is particularly applicable to the PTC heater disclosed in co-pending application Ser. No. 224,638, filed 7/27/88, same assignee.

In one example, the PTC heaters were equilateral triangles, approximately 2.29" each side, and ¼" thick. There were 423 holes (passages), 53 mils in diameter, in each PTC heater. Aluminum was hot sprayed on each triangular surface of the PTC heater to a thickness of about 3 to 8 mils. Each triangular surface was then roller coated with NAZ-DAR #211, a black solvent-removable resist ink made by Naz-Dar Company of Chicago, Ill. After the ink dried, the PTC heater was immersed in a 4% sodium hydroxide solution at 50° C. for two minutes, which dissolved all aluminum on the PTC heater which was not coated with the resist ink. The PTC heater was then thoroughly rinsed in water and then dried. The PTC heater was then immersed in a vapor degreasing tank containing trichloroethane and both liquid spray and vapor phase cleaning were used to remove all traces of the resist ink. The PTC heater was then heated at 500° C. to drive off moisture and other volatilizable contaminants.

We claim:

1. The method of electroding a PTC heater having surfaces to be electroded and also having passages for heating a fluid flowing therethrough comprising the steps of: hot aluminum spraying the PTC heater to adheredly coat said surfaces with aluminum; coating said aluminum-coated surfaces with a solvent-removable alkali-resistant resist ink; immersing the PTC heater in hot alkaline solution to dissolve and remove all aluminum that is not coated with resist ink; rinsing and drying the PTC heater; and solvent removing the resist ink from the PTC heater.

2. A passaged heater electroded by the method of claim 1.

* * * * *